United States Patent [19]

Goderbauer

[11] 4,025,044

[45] May 24, 1977

[54] METHOD OF MAKING A RESILIENT DOUBLE C-SHAPED CLIP FOR SECURING A RAIL ON A SUPPORT AND A CLIP MADE BY THE USE OF THIS METHOD

[75] Inventor: Lodewijk Goderbauer, Schaesberg, Netherlands

[73] Assignee: B.V. Schroefboutenfabriek v.h.Everts en van der Weijden, Heerlen, Netherlands

[22] Filed: Jan. 27, 1975

[21] Appl. No.: 544,377

[30] Foreign Application Priority Data

Feb. 26, 1974 Netherlands ..... 7402618

[52] U.S. Cl. ..... 238/349; 72/384; 72/702

[51] Int. Cl.[2] ..... E01B 9/00

[58] Field of Search ..... 238/378, 338, 349, 351, 238/352, 310; 72/384, 380, 364, 386, 702; 140/89; 29/173

[56] References Cited

UNITED STATES PATENTS

| | | | |
|---|---|---|---|
| 786,277 | 4/1905 | Ewins | 238/378 |
| 1,023,651 | 4/1912 | Humbert | 238/378 |
| 3,352,136 | 11/1967 | Clarke | 72/702 X |
| 3,459,018 | 8/1969 | Miller | 72/384 X |
| 3,589,950 | 6/1971 | Justusson | 140/89 X |

*Primary Examiner*—James R. Duzan
*Attorney, Agent, or Firm*—Snyder, Brown & Ramik

[57] ABSTRACT

A method of making a resilient double C-shaped clip for securing a rail on a support, wherein in advance of the heat treatment the ends adapted to cooperate with the support and with the foot of the rail are bent towards one another in the direction of the fastening force to such an extend that they are offset with respect with one another over a certain distance in relation to their position when the ready clip is free of load and wherein after the heat treatment the clip is subjected to a series of permanent deformations, each effected by imposing a permanent deformation force on one end of the clip while the other end is held in fixed position, such that upon a continued deformation there would be no increase or only a very small increase of the load, and the clip being relieved of load after each deformation.

16 Claims, 6 Drawing Figures

FIG. 1
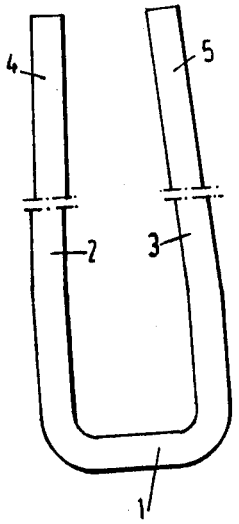
FIG. 2
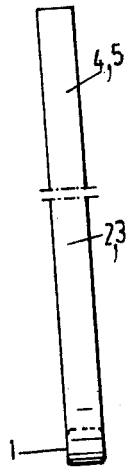
FIG. 5
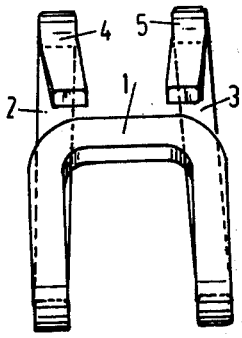
FIG. 6
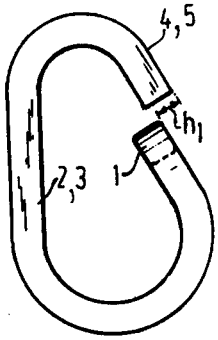
FIG.3
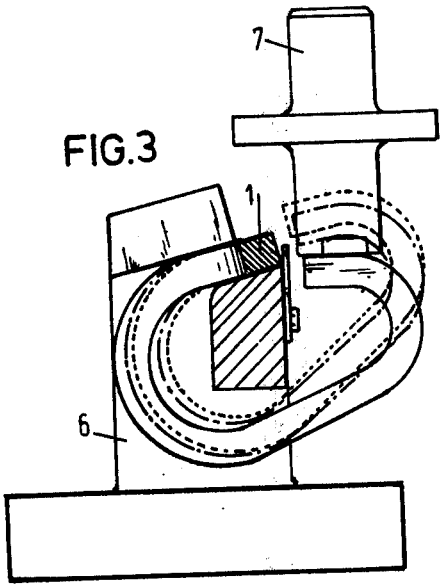
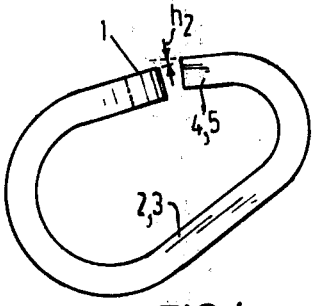
FIG.4

METHOD OF MAKING A RESILIENT DOUBLE C-SHAPED CLIP FOR SECURING A RAIL ON A SUPPORT AND A CLIP MADE BY THE USE OF THIS METHOD

This invention relates to a method of making a resilient double C-shaped clip for securing a rail on a support, the clip being adapted on the one hand to engage in a bearing secured to the support and on the other hand press on the rail foot, by bending a piece of bar material into the form of a U, then bending the free ends of the limbs and the web of the U towards one another in a direction perpendicular to the plane of the U and then hardening the resulting clip and subjecting it to a heat-treatment. The disadvantage of this method of producing a clip is that there appears to be considerable dispersion in the spring characteristics of the clip. In addition, a fairly large tolerance may occur in the final dimensions of the finished clip. particularly after it has been loaded once. Consequently, the clip tension cannot be accurately predetermined in operation, may be subject to variation, and may sometimes have to be corrected by the use of shims. The object of the invention is to provide a method wherein the said difficulties are obviated.

According to the invention, before the hardening and heat treatments the ends cooperating with the support and with the foot of the rail are bent towards one another to such an extent, in the same direction as or in the opposite direction to the fastening force occuring in the operational state, that in relation to their position when the ready clip is unloaded, they are offset with respect with one another relative to a predetermined final disposition thereof; and after the heat treatment the clip is subjected to a series of permanent deformations cumulatively to bring the ends thereof to the predetermined final disposition, each such permanent deformation being effected by imposing a permanent deformation force on one end of the clip while the other end is held fixed such that upon a continued deformation there would no increase or only a very small increase of the load of the clip, the clip being relieved of load after each deformation. With such a method of permanent deformation, there is a sharp increase in the permissible loading in the elastic range of the clip, and a very accurate final demension is obtained and is pratically maintained during operation or after several fitting and removal operations. The clamping force dispersion is greatly reduced, so that it is possible more accurately to predetermine and maintain the fixing forces in operation. Moreover one has the great advantage that the portion of the C-shaped clip, which is involved in the elastic deformation, is increasing.

Further according to the invention it is very advantageous that the clip is given each time such a permanent deformation, that upon a further displacement of said ends with respect with one another, the order of magnitude of the increase of the force occuring on said ends is less than 1/6 of the original increase of said force.

According to the invention, before hardening and heat-treatment the ends of the clip are offset in relation to the condition of the unloaded finished clip, by a distance of the order of magnitude of the distance through which the clip can be elastically deformed after the heat-treatment. Such a choice of the distances gives an appreciable permanent deformation of the clip during the manufacturing of the clip.

Finally, according to the invention, after a number of the described permanent deformations, the clip may also be subjected to a deformation equivalent to the deformation occurring when the clip is fitted on the support. This gives an extra guarantee that the permissible loading and deformation are not exceeded when the clip is fitted.

The invention also relates to a clip for fixing a rail on a support made in the manner described hereinbefore.

The invention will be explained in detail in the following description of one exemplified embodiment of making a clip according to the invention. In the drawing:

FIG. 1 shows a clip according to the invention in the first stage of manufacture, FIG. 2 is a side elevation of the clip of FIG. 1, FIG. 3 shows a clip during forming to the correct shape, FIG. 4 shows the finished clip, FIG. 5 shows the clip after the second stage of manufacture, and FIG. 6 is a side elevational view of the clip of FIG. 5 and illustrating its generally C-shaped form.

The clip is formed from bar material which is first bent into the form of a U. FIG. 1 shows the clip in a direction perpendicular to the plane of the U and FIG. 2 shows the clip in the direction of the plane of the U. The web 1 and limbs 2 and 3 will be seen. After the bar has been bent into the form of a U, the free ends 4, 5 of the limbs 2 and 3 and the part forming the web 1 of the U are so bent over as to produce the form generally C-shaped shown in FIGS. 5 and 6. The clip is then subjected to a heat treatment. it is first hardened and then annealed. The ends 4 and 5 are offset by a distance $h$ with respect to the web 1 as shown in FIG. 6, the ends thus being laterally offset from the predetermined disposition thereof which is illustrated in FIG. 4. The significance of this will be explained hereinafter.

FIG. 3 shows the clip of FIG. 2 clamped in a holder 6. That part of the clip adjacent the web 1 is fixed in the same way as the clip is retained in a holder in operation. A punch 7 cooperates with the free end of the clip formed by the ends 4 and 5 of the limbs 2 and 3. The clip initially has the shape shown in FIG. 6. The punch 7 presses the clip out of the dotted-line position into the solid-line position, permanent deformation occuring in these conditions. The pressure is then removed from the clip, which returns to the shape shown in dot-dash lines. The punch is then again moved downwards and the clip is pressed in further than the position shown in solid lines. In these conditions there is again a permanent deformation, and when the punch 7 is removed the clip assumes the shape shown in FIG. 4. In this position the distance between the web 1 and the ends 4, 5 of the clip is denoted by $h_2$. The cold deformation of the clip from the shape shown in FIG. 6 to the shape shown in FIG. 4 takes place in two steps. The pressure is removed from the clip after each permanent deformation. The clip may also be permanently deformed in more steps, a small permanent deformation being produced in each step. The pressure must be removed from the clip after each permanent deformation before any further deformation is produced. With the deformation method described, a very small tolerance is obtained for the final dimensions of the clip, and the clamping force is accurately predetermined and constant during operation.

What I claim is:

1. The method of making a clip for securing a rail on a support, which comprises the steps of:

a. bending a length of bar material into a U-shaped configuration;

b. bending the U-shaped configuration of step (a) transversely of the plane of such configuration to define a generally C-shaped clip in which the free ends of the C-shape are laterally offset, in the plane of the C-shape, from a predetermined final disposition thereof;

c. subjecting the C-shaped clip to hardening and heat treatment;

d. fixedly holding one end of the C-shaped clip while exerting a first force against the other end of the clip in a direction and of such magnitude as to effect a continuous movement of said other end and produce a permanent deformation of said ends toward said final disposition thereof, and then releasing said force to allow said ends of the clip to spring back to that permanently deformed position effected by said first force; and e. repeating step (d) at least once with an increased force to effect further permanent deformation of said ends to said final disposition thereof.

2. The method according to claim 1 wherein each force exerted in step (e) is increased with respect to the immediately preceding force by an amount less than 1/6th of the increase in force required to effect said first deformation.

3. The method according to claim 2 wherein said ends of the clip are offset from said final disposition in step (b) by an amount in the order of magnitude of the amount of elastic deformation which may be imparted to the clip subsequent to the hardening and heat treatment of step (c).

4. The method according to claim 1 wherein said ends of the clip are offset from said final disposition in step (b) by an amount in the order of magnitude of the amount of elastic deformation which may be imparted to the clip subsequent to the hardening and heat treatment of step (c).

5. The method according to claim 4 wherein during step (e) said ends of the clip are imparted of a final deformation equivalent to that deformation imparted to the clip during use.

6. The method according to claim 3 wherein during step (e) said ends of the clip are imparted of a final deformation equivalent to that deformation imparted to the clip during.

7. The method according to claim 2 wherein during step (e) said ends of the clip are imparted of a final deformation equivalent to that deformation imparted to the clip during use.

8. The method according to claim 1 wherein during step (e) said ends of the clip are imparted of a final deformation equivalent to that deformation imparted to the clip during use.

9. A resilient clip for securing a rail on a support, which clip is made by the method defined in claim 1.

10. A resilient clip for securing a rail on a support, which clip is made by the method defined in claim 2.

11. A resilient clip for securing a rail on a support, which clip is made by the method defined in claim 3.

12. A resilient clip for securing a rail on a support, which clip is made by the method defined in claim 4.

13. A resilient clip for securing a rail on a support, which clip is made by the method defined in claim 5.

14. A resilient clip for securing a rail on a support, which clip is made by the method defined in claim 6.

15. A resilient clip for securing a rail on a support, which clip is made by the method defined in claim 7.

16. A resilient clip for securing a rail on a support, which clip is made by the method defined in claim 8.

* * * * *